US007578723B2

(12) United States Patent
Morioka

(10) Patent No.: US 7,578,723 B2
(45) Date of Patent: Aug. 25, 2009

(54) POLISHING TAPE AND POLISHING DEVICE USING SAME

(75) Inventor: Izuru Morioka, Tokyo (JP)

(73) Assignee: NIHON Microcoating Co., Ltd., Tokyo (JP)

( * ) Notice: Subject to any disclaimer, the term of this patent is extended or adjusted under 35 U.S.C. 154(b) by 180 days.

(21) Appl. No.: 11/784,956

(22) Filed: Apr. 9, 2007

(65) Prior Publication Data

US 2007/0287360 A1 Dec. 13, 2007

(30) Foreign Application Priority Data

Jun. 8, 2006 (JP) ..... 2006-159196

(51) Int. Cl.
*B24B 49/00* (2006.01)

(52) U.S. Cl. ..... 451/5; 451/8

(58) Field of Classification Search ..... 451/5, 451/8

See application file for complete search history.

(56) References Cited

U.S. PATENT DOCUMENTS

| | | | | |
|---|---|---|---|---|
| 5,643,044 | A * | 7/1997 | Lund | 451/5 |
| 5,733,181 | A * | 3/1998 | Hasegawa et al. | 451/168 |
| 5,791,969 | A * | 8/1998 | Lund | 451/5 |
| 6,458,021 | B1 * | 10/2002 | Takeyama et al. | 451/302 |
| 6,558,239 | B2 * | 5/2003 | Kunisawa et al. | 451/303 |
| 6,824,320 | B1 * | 11/2004 | Kerr et al. | 396/512 |
| 7,349,627 | B2 * | 3/2008 | Kerr et al. | 396/310 |
| 2002/0098787 | A1 * | 7/2002 | Kunisawa et al. | 451/307 |
| 2005/0086480 | A1 * | 4/2005 | Kerr et al. | 713/176 |

* cited by examiner

*Primary Examiner*—Maurina Rachuba
(74) *Attorney, Agent, or Firm*—Weaver Austin Villeneuve & Sampson LLP

(57) ABSTRACT

A polishing device has a reel core around which a polishing tape is wound and a reel plate with flanges that engage with the polishing tape and sandwich it from both sides. A memory element with data on the polishing tape is provided to the reel core such that errors caused by using a wrong kind of polishing tape can be obviated.

3 Claims, 2 Drawing Sheets

POLISHING TAPE AND POLISHING DEVICE USING SAME

This application claims priority on Japanese Patent Application 2006-159196 filed Jun. 8, 2006.

BACKGROUND OF THE INVENTION

This invention relates to a polishing device for polishing the main and end surfaces of a semiconductor wafer, a liquid crystal panel, a magnetic disk substrate, an optical fiber connecting part, etc. by means of a polishing tape. More particularly, this invention relates to such a polishing device capable of mechanically carrying out a control of the sequence of polishing steps, the kinds of the polishing tapes and the quality of the produced lots when a polishing process is carried out in a plurality of steps by exchanging polishing tapes.

A thin film is formed over a target object to be polished such as the surface of a semiconductor wafer (as shown in FIG. 10A) but the thin film portions on the beveled portion (B) along the edge of the semiconductor wafer and the edge portion (E) which is a circumferential portion along the inner surface from this beveled potion tend to become a source of particles and other contaminants and hence should be removed. Particles may also be generated from rough areas generated over a beveled portion, depending on the kind of the production process for a semiconductor device such that an improvement in the surface accuracy is coming to be required of portions from which the thin film has been removed.

As disclosed in Japanese Patent Publications Tokkai 2002-208572 and 2003-234314, devices are being developed for removing an unwanted thin film such as a film from portions of a semiconductor wafer surface as described above by using a polishing tape. These devices are adapted to pass a polishing tape from the upper surface to an end surface and then to the lower surface of a semiconductor wafer and to use a polishing head to press the polishing tape onto the semiconductor wafer for removing the unwanted film portions.

When a target object is polished, polishing tapes in several grades including a rough one and a fine finishing tape are alternatingly used for the polishing operation. If an error is committed in exchanging the tapes in this operation, many defective products may end up being produced in the case of an automatic polishing operation. If defective products are mixed in a production lot, it is necessary to quickly detect and remove the defective lot and to investigate the cause of the event. This adversely affects the yield.

A commonly practiced method of distinguishing among polishing tapes of different kinds has been to add different coloring agents into the paints for the polishing tapes but this gives rise to the problem that these coloring agents may turn out to be another source of contamination. It was also a problem that the addition of a coloring agent may adversely affect the polishing characteristic.

Another method of distinguishing among polishing tapes has been to provide a mark on the end surface of the polishing tape or the end surface of the reel core. Since such marks cannot be easily converted into an electrical signal, the distinction must be made visually and judgment errors remained likely to occur. Since the quantity of data is small with such marks, furthermore, it was not possible to carry out the analysis of quality control.

SUMMARY OF THE INVENTION

It is therefore an object of this invention in view of the problems described above to provide polishing tapes and a polishing device using such polishing tapes with which errors in exchanging them can be eliminated, defective tapes can be quickly detected and quality control can be carried out easily.

A polishing device according to one embodiment of this invention may be characterized as using polishing tapes to polish a target object and as comprising a reel core for winding a polishing tape around, a reel plate having flanges that engage with the polishing tape and sandwich it from both sides and a memory element that is provided to the reel core and stores data on the polishing tapes.

In the above, the memory element may be disposed near a peripheral edge portion of the reel core, and the data may include those for identifying the polishing tapes and also for quality control of the polishing tapes. More specifically, the data may include at least one selected from the group consisting of the kind, production record and quality record of the polishing tape.

The polishing device of this invention may further include a data reading part provided on an outer peripheral surface of the flange for the memory element. It may also further include a control device. For example, the control device may include a memory that stores polishing condition data, serving to compare data stored by the memory element and the polishing condition data stored by the memory and to drive the polishing device only if these compared data match.

In the case of a polishing process that is carried out by using a plurality of polishing tapes, the polishing device of this invention may be adapted to compare data stored by the memory element and the polishing condition data stored by the memory for each of these plurality of polishing tapes used in the polishing process and to drive the polishing device only if these compared data match.

In the above, the memory element may comprise an IC chip.

The invention also relates to a polishing tape wound around a reel core provided with a memory element that stores data for identifying polishing tapes and also for quality control of the polishing tapes.

DETAILED DESCRIPTION OF THE INVENTION

Figure 1:
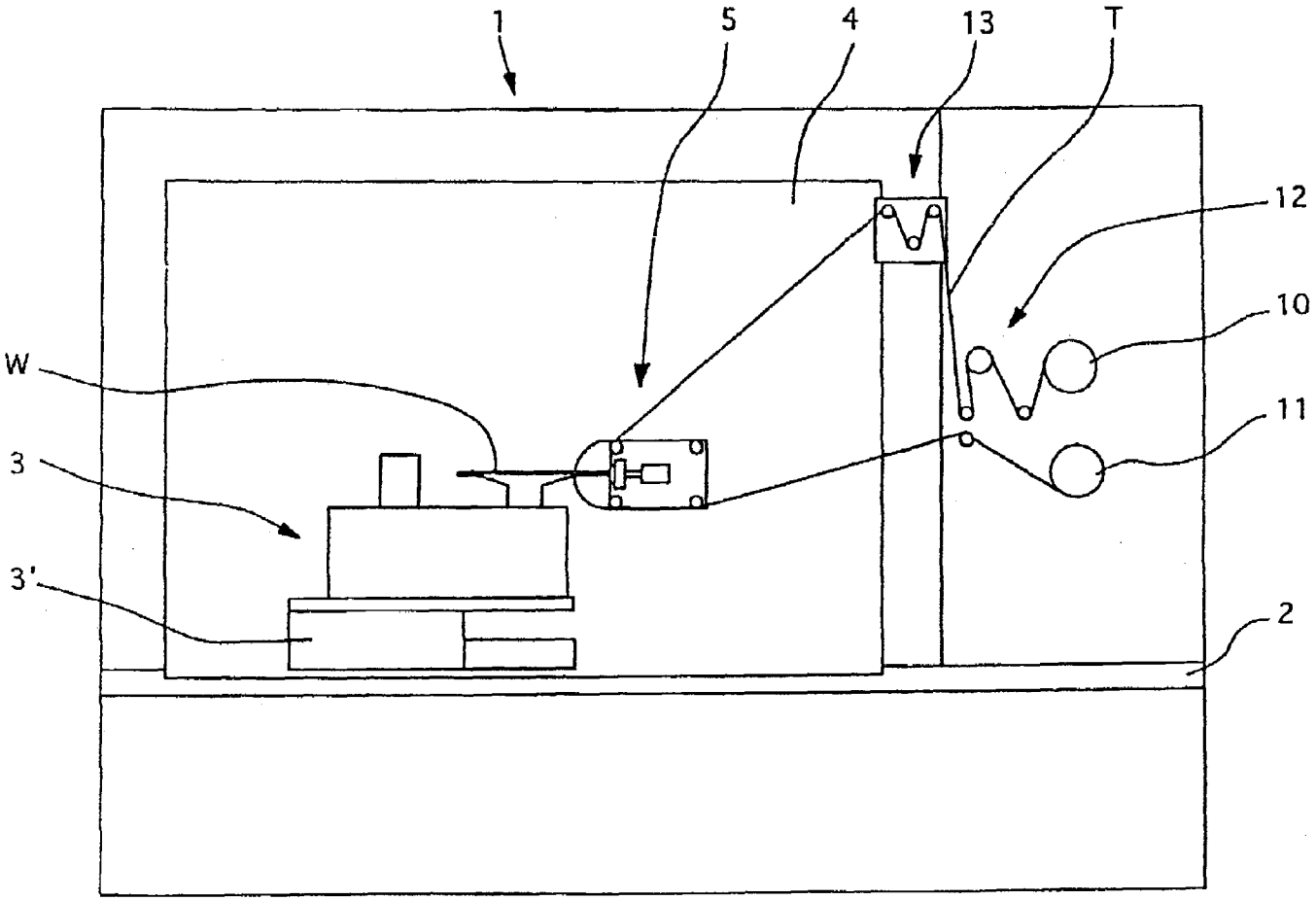
FIG. 1 is a schematic view of a polishing device embodying this invention.

The invention is described next with reference to the drawings. FIG. 1 shows an example of polishing device 1 embodying this invention, comprising a horizontal table plate 2 and a moving device 3 set thereon for moving a target object W to be polished in an up-down direction, rotating it and moving it horizontally.

A polishing head 5 is provided to a front plate 4 which is perpendicularly attached to the table plate 2. If necessary, a pipe for supplying water to be used for the polishing and a pipe for supplying the agents necessary for the chemical-mechanical polishing may be set on this front plate 4.

A supply roller 10 for supplying a polishing tape T and a wind-up roller 11 for winding up the polishing tape T are set on a plate disposed on one side of the table plate 2. In addition, feed rollers 12 and auxiliary rollers 13 are provided. The feed rollers 12 are for feeding the polishing tape T at a constant speed, and the auxiliary rollers 13 are for preventing the polishing tape T from experiencing any needlessly large stress as the polishing head 5 undergoes an oscillating (reciprocating) motion.

Figure 2:
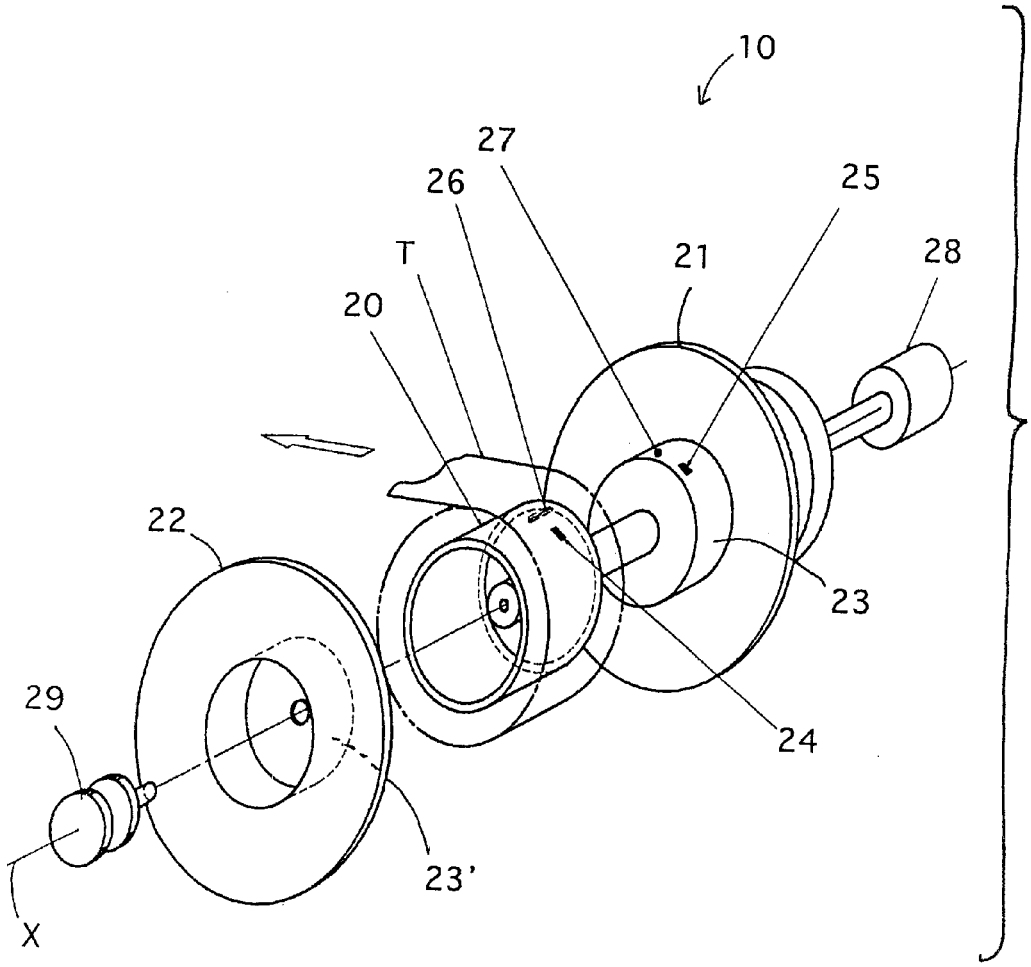
FIG. 2 is an exploded diagonal view of an example of polishing tape containing an IC chip of this invention.

FIG. 2 is an exploded diagonal view of the supply roller 10 for supplying the polishing tape T, including a reel core 20 around which the polishing tape T is wound and reel plates 21 and 22 which sandwich the reel core 20 from both sides to thereby hold it. The reel plates 21 and 22 are provided with flanges 23 and 23' engaging with the reel core 20. The reel plates 21 and 22, the real core 20 and the flanges 23 and 23' are disposed coaxially with the axial line X and are fastened by means of a reel attaching knob 29.

According to a preferred embodiment of the invention, a memory element 24 such as an IC chip is embedded in the reel core 20. The IC chip 24 has recorded thereon as electronic data information useful for identifying polishing tapes such as their kinds, production histories and quality records, as well as for quality control such that a defective polishing tape can be quickly identified in the case of occurrence of defective polishing of a target object. The IC chip 24 may be preferably placed on the inner side of the reel core 20 at a peripheral portion.

An ID data reading part 25 and a protrusion are provided on the outer peripheral surface of the flange 23, and a small fine groove 26 is formed near the inner peripheral edge part of the reel core 20 along the direction of the axial line X. As the reel core 20 engages with the flange 23, the fine groove 26 engages with the protrusion 26 such that the IC chip 24 is properly positioned with respect to the IC data reading part 25.

There is also a slip ring 28 provided on the axial line X for transmitting signal data from the IC chip 24 to a control device (not shown) provided, for example, with a programmable control circuit and a memory for storing polishing conditions for target objects. Such a control device may be provided additionally with an external memory for storing the data on the IC chip such as the kinds of polishing tapes (such as the kinds of the abrading particles, their grain diameters, surface roughness, as well as mechanical characteristics and physical values including the binder and the base film), lot numbers, and production records such as the production dates. The control device may be further adapted to optimize the conditions for the polishing operation from the results of a polishing operation after a target object has been polished such that the setting of polishing conditions may be sequentially updated. Moreover, polishing conditions other than those preliminarily set may be manually inputted. In such a case, a warning lamp may be caused to blink so as to output a warning, if the inputted value exceeds a certain threshold value. The control circuit may include electric circuits of all kinds and may be formed with a single circuit or a plurality of circuits.

Next, a method of identifying polishing tapes will be explained.

Firstly, the operator sets polishing conditions either manually or by making a selection from a menu of the control device according to the target object to be polished such that these polishing conditions are loaded in the memory of the control device. Next, as the operator attaches the reel core 20 of the polishing tape T, the data stored on the IC chip 24 are read out by the IC data reading part 25 and transmitted through the slip ring 28 to the control device. The control device compares the polishing conditions loaded in the memory and the data transmitted from the IC chip 24. If they are found to match as a result of the comparison, the polishing device 1 enters an operating condition. If they do not match, the polishing device 1 is not activated.

In summary, errors in exchanging polishing tapes can be obviated by embedding an IC chip in the reel core of each polishing tape. Since the history of each polishing tape is recorded, it becomes possible to identify a defective tape. Thus, this invention has the merit of reducing defective polishing.

What is claimed is:

1. A polishing device for using polishing tapes to polish a target object, said polishing device comprising:

a reel core for winding a polishing tape around;

a reel plate having flanges that engage with said polishing tape and sandwich said polishing tape from both sides;

a memory element that stores data on said polishing tape, said memory element being provided to said reel core; and a data reading part for said memory element, said data reading part being provided on an outer peripheral surface of said flange.

2. A polishing device for using polishing tapes to polish a target object, said polishing device comprising:

a reel core for winding a polishing tape around;

a reel plate having flanges that engage with said polishing tape and sandwich said polishing tape from both sides;

a memory element that stores data on said polishing tape, said memory element being provided to said reel core; and a control device including a memory that stores polishing condition data, wherein said control device compares data stored by said memory element and said polishing condition data stored by said memory and serves to drive said polishing device only if these compared data match.

3. A polishing device for using polishing tapes to polish a target object, said polishing device comprising:

a reel core for winding a polishing tape around;

a reel plate having flanges that engage with said polishing tape and sandwich said polishing tape from both sides;

a memory element that stores data on said polishing tape, said memory element being provided to said reel core; and a control device including a memory that stores polishing condition data, wherein said control device, when in a polishing process by using a plurality of polishing tapes, compares data stored by said memory element and said polishing condition data stored by said memory for each of the plurality of polishing tapes used in said polishing process and serves to drive said polishing device only if these compared data match.

* * * * *